US007754951B2

(12) United States Patent
Thornhill

(10) Patent No.: US 7,754,951 B2
(45) Date of Patent: Jul. 13, 2010

(54) STRING INSTRUMENT HAVING A REAR CHAMBER WITH A FLANGED SOUND PROJECTION VENT

(76) Inventor: Horace Greely Thornhill, 117 Apple Cir., Crossville, TN (US) 38555

( * ) Notice: Subject to any disclaimer, the term of this patent is extended or adjusted under 35 U.S.C. 154(b) by 0 days.

(21) Appl. No.: 12/080,704

(22) Filed: Apr. 5, 2008

(65) Prior Publication Data

US 2008/0250910 A1 Oct. 16, 2008

(51) Int. Cl.
*G10D 3/00* (2006.01)

(52) U.S. Cl. ..... 84/294; 84/291; 84/267

(58) Field of Classification Search ..... 84/294, 84/291, 267, 184, 187, 192
See application file for complete search history.

(56) References Cited

U.S. PATENT DOCUMENTS

| | | | | | |
|---|---|---|---|---|---|
| 292,580 | A | * | 1/1884 | Perry | 84/184 |
| 462,645 | A | * | 11/1891 | Weber | 84/192 |
| 542,561 | A | * | 7/1895 | Holcomb | 84/271 |
| 860,350 | A | * | 7/1907 | Clopton | 84/268 |
| 906,612 | A | * | 12/1908 | Cayton | 84/291 |
| 1,001,302 | A | * | 8/1911 | Rauch | 84/291 |
| 1,010,240 | A | * | 11/1911 | Degulio | 84/294 |
| 1,022,031 | A | * | 4/1912 | Larson | 84/263 |
| 1,883,503 | A | * | 10/1932 | Blondin | 84/267 |
| 2,045,265 | A | * | 6/1936 | Dopyera | 84/292 |
| 2,270,612 | A | * | 1/1942 | Holman | 84/267 |
| 2,300,012 | A | * | 10/1942 | Rubinstein | 84/174 |
| 2,561,883 | A | * | 7/1951 | Pegrum | 84/189 |
| 3,051,033 | A | * | 8/1962 | Pratt | 84/265 |
| 3,298,268 | A | * | 1/1967 | Thyen | 84/184 |
| 3,425,308 | A | * | 2/1969 | Astin et al. | 84/192 |
| 4,317,402 | A | * | 3/1982 | McPherson, Sr. | 84/291 |
| 4,320,684 | A | * | 3/1982 | Podunavac | 84/291 |
| 4,467,692 | A | * | 8/1984 | Egan | 84/291 |
| D280,521 | S | * | 9/1985 | Wechter | D17/19 |
| 4,796,504 | A | * | 1/1989 | McWillis | 84/265 |
| D299,834 | S | * | 2/1989 | Clark | D17/20 |
| D303,270 | S | * | 9/1989 | Kaman, II | D17/14 |
| 5,025,695 | A | * | 6/1991 | Viel | 84/293 |
| 5,581,043 | A | * | 12/1996 | Bowar | 84/291 |
| 5,689,074 | A | * | 11/1997 | Penridge | 84/294 |
| 5,854,435 | A | * | 12/1998 | Kim | 84/291 |
| 5,918,299 | A | * | 6/1999 | Yui | 84/291 |
| 5,922,979 | A | * | 7/1999 | Yui | 84/291 |
| 5,952,591 | A | * | 9/1999 | Thurman | 84/267 |
| 6,040,510 | A | * | 3/2000 | Yaun | 84/294 |
| 6,376,755 | B1 | * | 4/2002 | Kammerer | 84/290 |
| 6,646,191 | B1 | * | 11/2003 | Martin | 84/291 |

(Continued)

*Primary Examiner*—Jeffrey Donels
*Assistant Examiner*—Robert W Horn

(57) ABSTRACT

A string musical instrument, such as but not limited to a guitar, whose sides are angled; and without relief holes in the instrument's soundboard, or top; with the absence of a hole on the instrument's top that allows more sound to be produced by the remaining material in the top, where the sound hole might have been; whose relief holes are located on the "inner back" which is attached to the angled sides; that embodies a second, or "outer back," identically contoured or shaped like the inner back but whose outer dimensions are equal to the outer dimensions of the instrument's top, with a sound chamber created by the proximity of the inner back with the outer back, whose outer back embodies a shaped flange designed to direct the instrument's sound forward, and embodies a series of springs attached to both the bridge plate and inner back of the instrument, designed to create a reverb effect.

14 Claims, 4 Drawing Sheets

U.S. PATENT DOCUMENTS

| | | | | |
|---|---|---|---|---|
| 7,288,706 | B2 * | 10/2007 | Gaffga | 84/291 |
| 7,446,247 | B2 * | 11/2008 | Shellhammer | 84/291 |
| 7,473,831 | B2 * | 1/2009 | Cody | 84/291 |
| 7,498,495 | B1 * | 3/2009 | Mooers | 84/265 |
| 7,579,534 | B1 * | 8/2009 | Ryan | 84/291 |
| 2008/0250910 | A1 * | 10/2008 | Thornhill | 84/294 |

* cited by examiner

PREFERRED EMBODIMENT

PREFERRED EMBODIMENT

PREFERRED EMBODIMENT
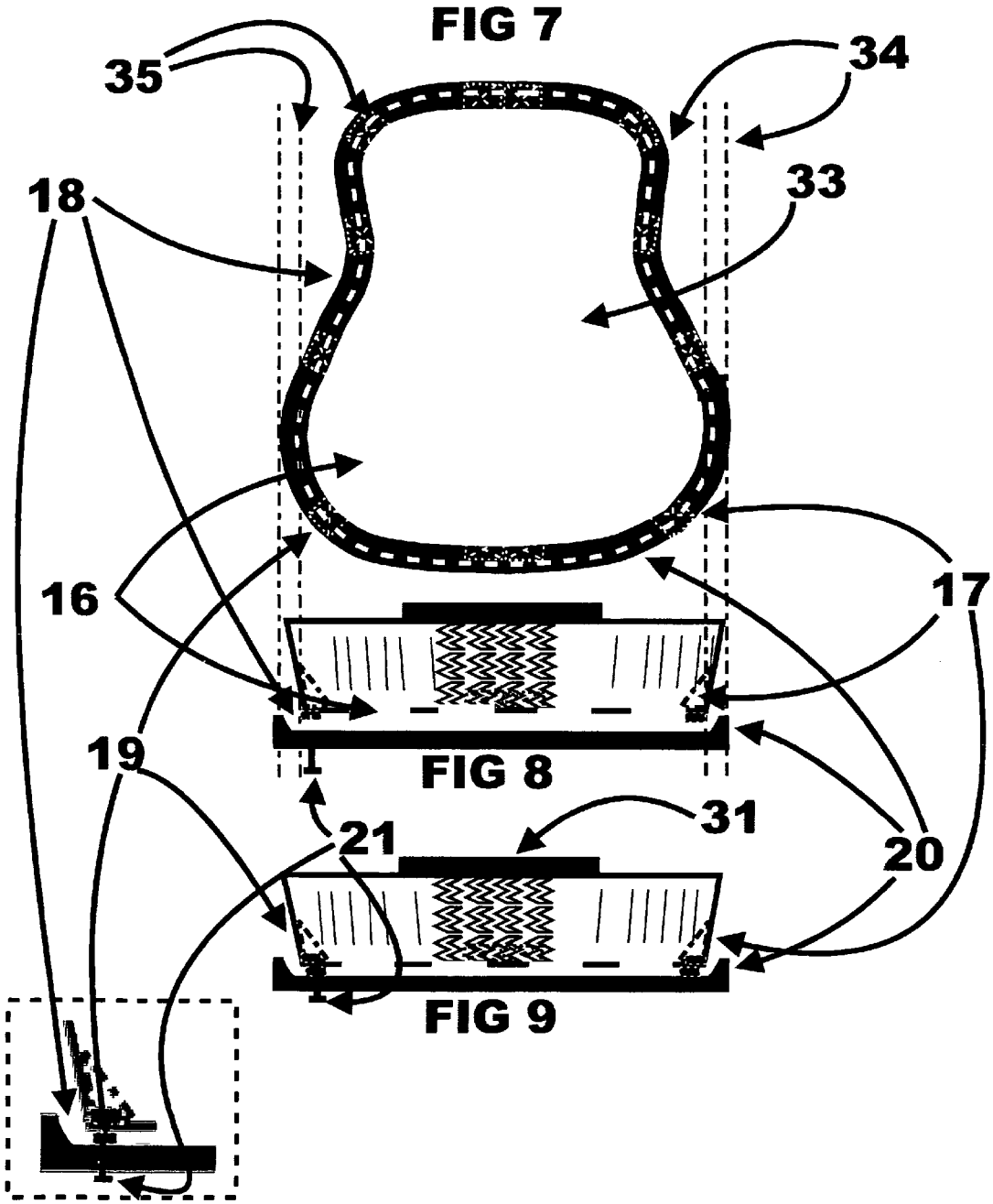

STRING INSTRUMENT HAVING A REAR CHAMBER WITH A FLANGED SOUND PROJECTION VENT

CROSS REFERENCE TO RELATED APPLICATIONS

This application is based on application Ser. No. 12/080,704.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of music and more specifically to a machine for making music. Historical documentation of string instruments dates back to the Biblical harp. Centuries later, other string instruments appeared, such as the lute and the violin. These instruments and all those prior instruments were strung with animal sinew or processed animal gut. In recent times, the guitar, mandolin, and banjo appeared. The earliest versions of these instruments also utilized animal sinew or gut for strings. These were and are known as classical instruments.

Within the past one hundred years, guitars and other acoustic instruments began to appear with metal strings. These metal strings had the effect of producing a higher volume of sound with fuller, brighter frequency response. Within the guitar realm, two of these steel string instruments emerged as standards: the flat top guitar with a "round" hole and the arch top guitar with the "F" hole. The flat top guitar evolved into what is known as an open chord rhythm instrument, as well as a flat picking lead instrument; while the arch top guitar evolved into the closed chord instrument, used in the beginning for closed chord rhythm instrument which evolved into an electric lead instrument. Many of both types of these instruments were eventually outfitted with electronic devices such as pickups and amplifiers, designed to increase the volume through electronic amplification.

While modern instruments have embodied vast improvements over their predecessors, they nevertheless have embodied and still do embody severe deficiencies. The arch top guitar lacked the ringing sound of the flat top guitar and produced limited volume compared to its counterpart. The flat top guitar produced more volume and a brighter sound, but it nevertheless has always had certain shortcomings which include: a loss of frequency response on the bass strings; a distinct loss of volume in certain frequencies and on certain strings; an inability to produce omni-directional sound at certain frequencies and from certain strings; a mushiness, particularly on the bass strings, that causes the instrument to get "lost" when used with certain types of musical groups or bands because of the instrument's inability to "cut through" the sound of other instruments. Furthermore, the sound from this type instrument is projected mostly forward; therefore the musician hears a much lower volume of sound than the audience. This makes soloing difficult for the guitarist who is surrounded by other instruments that are individually and collectively designed to produce more volume.

BRIEF SUMMARY OF THE INVENTION

The primary object of the invention is that it is designed to produce a higher volume of sound.

Another object of the invention is that it is designed to produce a more complete range of frequencies.

Another object of the invention is that its design embodies additional beneficial features over standard instruments designs without infringing on or compromising the standard dimensions visual appeal of a given instrument.

In accordance with a preferred embodiment of the invention, there is disclosed a machine for making music comprising: A string musical instrument, such as but not limited to a guitar; whose sides are angled; without relief holes in the instrument's soundboard, or top; whereby the absence of the standard placement of the sound hole on the instrument's top allows more sound to be produced by the material that remains on the soundboard, where the sound hole might have been; whose relief hole(s) are located on the "inner back"; that embodies a second, or "outer back," contoured or shaped like the inner back; with a sound chamber created by the proximity of the inner back with the outer back; whose outer back embodies a shaped flange designed to direct the instrument's sound omni-directionally, and whereby a series of springs attached to both the bridge plate and inner back of the instrument which extends the length of sounds and creates a reverb effect.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 7 is an inside view of the outer back of the Preferred Embodiment of the invention.

FIG. 8 is a rear, or bottom view of the outer back, unattached, of the Preferred Embodiment of the invention.

FIG. 9 is a rear, or bottom view of the outer back, attached to the inner back, of the Preferred Embodiment of the invention, and a breakout from FIG. 9.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention.

Figures 1, 2:
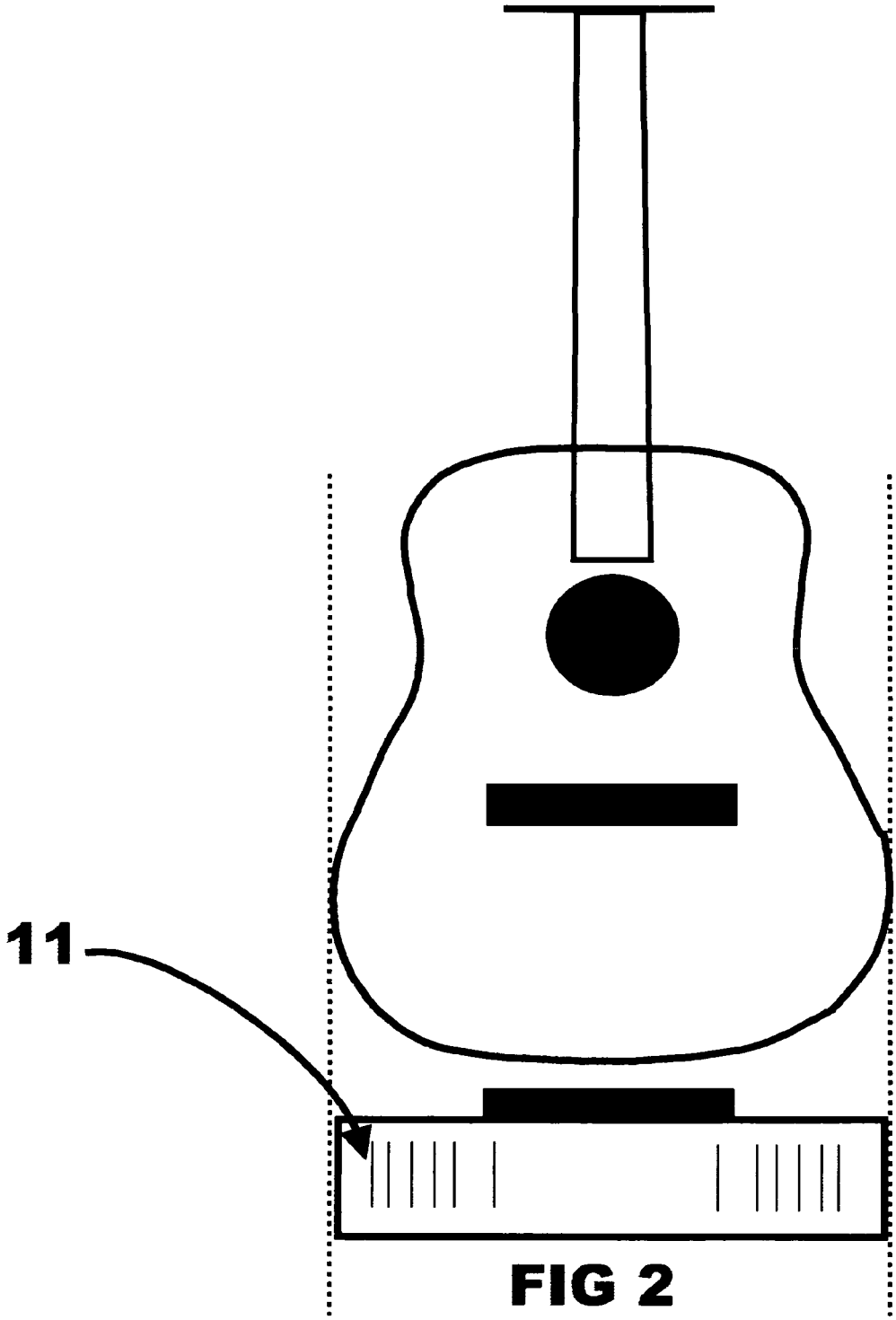
PRIOR ART FIG 1
FIG. 1 is a frontal or top view of Prior Art of the invention.
FIG. 2 is a rear view of Prior Art of the invention.
Figures 3, 4:
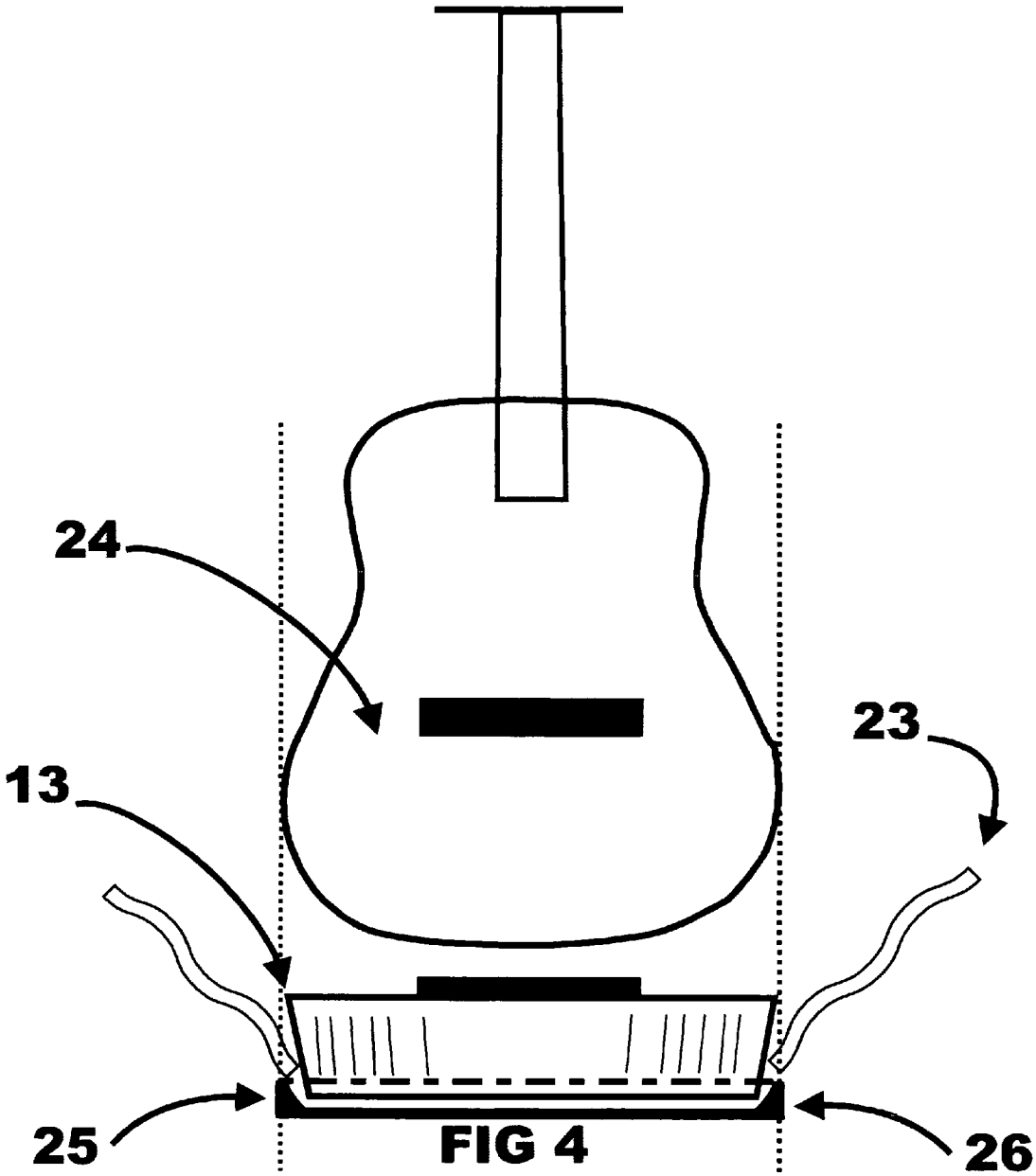
FIG. 3 is a frontal or top view of the Preferred Embodiment of the invention.
FIG. 4 is a rear or bottom view of the Preferred Embodiment of the invention.
Figures 5, 6:
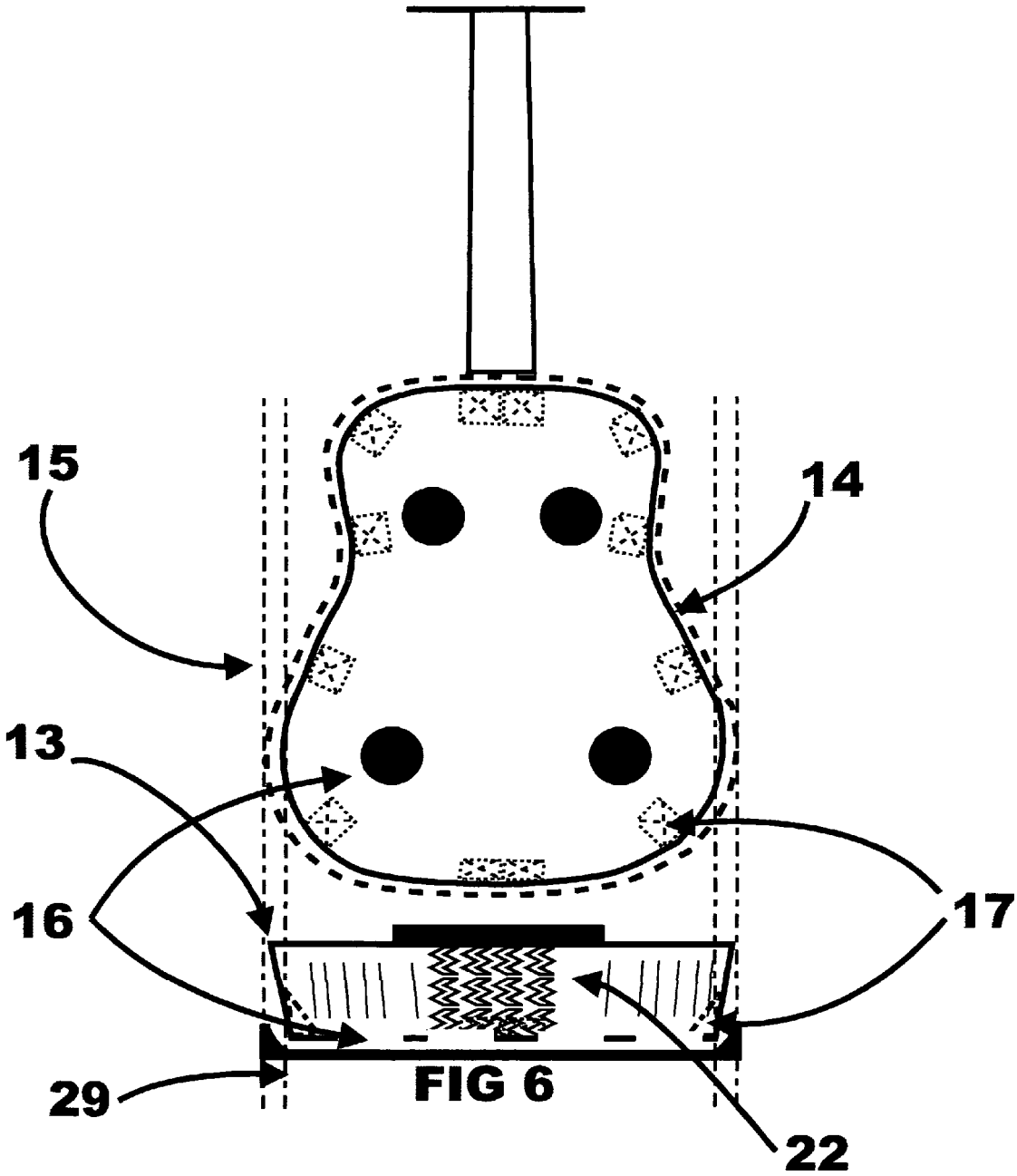
FIG. 5 is the inner back of the Preferred Embodiment of the invention, depicted by the solid line, with the dotted line depicting the dimensions of the outer back.
FIG. 6 is a rear, or bottom view of the inner back of the Preferred Embodiment of the invention.

Turning to FIG. 1, Number 10 illustrates the top of an instrument produced with prior art. The opening in the top of the instrument is calculated to cause the instrument to "pump" when the strings are plucked or strummed. This pumping action, generated by the vibration of the strings against the bridge, which is then transmitted to the soundboard, or top of the instrument, excites the air inside the primary sound chamber and forces sound energy out of the hole and projects it forward. FIG. 2 number 11, shows a rear, or bottom view of the prior art. Note that the sides of the instrument are perpendicular with the top of the instrument. Turning now to FIG. 3 of the preferred embodiment of the invention, note that the top of the invention is essentially the same as shown on the prior art, with the exception of the absence of the hole. However, turning to FIG. 4, it can clearly be seen from the rear, or bottom view of the invention that the sides, number 13, of the invention are set at an angle. This angle may be more or less, depending on the amount of compression of the sound waves desired. Turning to FIG. 5, number 16 depicts holes in the inner back of the invention. The holes in the outer back are calculated to allow the compressed sound to escape from the inner body, or primary sound chamber of the invention. Number 15, the dotted line, shows the dimensions of the top, FIG. 3 number 24, relative to the outside dimensions of the inner back, FIG. 6, number 29. Turning back to FIG. 4, note that the outer dimensions of the outer back, number 25, is essentially the same as the top, or soundboard, FIG. 3 number 24, of the invention. The difference in size between the outer dimensions of the top, number 24, and the outside dimensions of the inner back, FIG. 4 number 13, provides an opening all the way around the invention, number 26, which allows compressed sound, number 23, to be emitted all the way around the invention. Turning now to FIG. 7, the outer back of the invention, number 33, is shown. The outer back is shaped to match the shape of the inner back. As the inner back and the outer back reside in proximity, this provides a sound chamber that distributes the sound evenly all around the invention. FIG. 8 depicts a rear view of the invention with the outer back unattached. Number 19 depicts spacers which hold the outer back away from the inner back at a distance, that is calculated to achieve the volume and tone desired, projected to be from one-forth inch to one inch spacing. Number 17 of FIGS. 5 and 6 depicts the posts which are attached to both the sides and the inside of the inner back, through which fasteners, FIG. 8 and FIG. 9, number 21, are passed for the purpose of securing the outer back to the inner back. FIG. 9 depicts the outer back fastened to the inner back of the invention. FIGS. 7 and 8 number 18 depicts a flange, fluted on the inside, that completely encircles the invention. This fluted shape is designed to project the sound forward, omni-directionally. The space between the inner back and the outer back, the sound chamber, may be made wider or narrower to effect the tone (base and treble) of the sound emitted from the opening or sound chamber, FIG. 4 number 26. FIG. 6 number 22, depicts springs that are attached to the underside of the bridge or bridge plate, number 31, for the purpose of extending the resonance of the invention, and for adding a reverb effect to the sound.

The embodiment of this invention may also be applied to other instruments, such as, but not limited to, violins, mandolins, pianos, steel guitars, bass guitars, autoharps, etc. Furthermore, while these instruments are typically made of wood, certain components of the invention might also be made from, but not limited to, inorganic elements, such as plastic, fiberboard, or metal, etc. For example, the inner back might be made from metal for a more brash sound, or fiberboard to affect yet a different tone or to achieve an increase in volume. Returning to FIG. 7 number 34 depicts the outside perimeter of the outer back. FIG. 7 number 35, with dotted lines, depicts the outer perimeter of the inner back.

What is claimed:

1. A string musical instrument comprising:

strings to produce sound, where the energy of the vibrating strings is transmitted into the instrument body by means of a string bridge, a primary sound box, or chamber, further comprising an outer back with a continuous vent along the rim and a projection flange, an inner back forward of the outer back, a sound board at the front having a string bridge, all of which form the primary sound box, or chamber, and an angled side wall angling inward from the front interconnecting the edges of the soundboard and the inner back wherein said sound box forms a first resonance cavity between the said sound board and the said inner back and the said angled side walls, the inner back has sound holes to communicate sound into a second sound chamber that is formed between the said inner back and the said outer back, an outer back with an outward facing continuous vent along a perimeter rim of the outer back release sound from the said second sound chamber and the projection flange projects the sound forward along the angling side walls;

the soundboard vibrates and excites the air inside the said first cavity causing sound, the sound is then communicated out the said holes in the said inner back, which is then forced to the continuous vent at the outer rim of the said second sound chamber and is projected forward from the outer back by the said projection flange.

2. The string instrument of claim 1 wherein the said invention is an acoustical guitar.

3. The string instrument of claim 1, wherein said side walls are angled inward from the soundboard and attached to the inner back, causing the primary sound of the invention to have a speaker cone effect, said soundboard is without relief holes, said inner back contains relief holes, and said outer back is contoured in the same shape as the said inner back to efficiently project musical sounds omni-directionally.

4. The string instrument of claim 1 wherein the invention has angled sides that compress musical sounds within the said cavity, which are generated by the said soundboard of the machine, but whose angle (side), when and if changed, must be recalculated in order to affect more or less compression of the sound generated by the invention to cooperate with the inner back sound holes to project a desired sound or frequency range, wherein the angle of the said sides cooperate with a size and orientation of the said sound holes to facilitate a preferred amount of relief of the compressed sound.

5. The machine string instrument of claim 1 wherein the invention has a fluted flange on the outer rim of the outer back which directs and projects the emitted sound omni-directionally, wherein the invention has an inner back and an outer back, both contoured in the same shape and configuration, residing or spaced in proximity to each other so as to constitute a second sound chamber that is thinner than the first sound chamber, and whose spacing will be changed, if need be, to affect the volume and tone of the invention.

6. The string instrument of claim 1 wherein the invention has a fluted flange, or projection flange, on the outer rim or edge of the outer back which intercepts the sound coming out of the said sound chamber and directs and projects the emitted sound forward omni-directionally.

7. The string instrument of claim 1 wherein the invention utilizes holes in the said soundboard of the invention, wherein such holes will be designed to provide more perfect relief of the compressed sound emitted from the said sound chamber of the invention, thereby combining with the projected sound to constitute a full range of musical frequencies, wherein such holes will be strategically placed so as to project the sound in a more forward direction.

8. The string instrument of claim 1 wherein the invention utilizes strategic placement of holes on the top or soundboard of the invention to complement different design types of musical instruments, wherein placement of a hole on the bass side of the top, or soundboard, in the creation of an acoustical bass guitar when using the design concept of the said invention.

9. The string instrument of claim 1 wherein the placement of holes on the inner back to defuse and distribute the sound differently, as well as have an effect on the tone generated by the said invention.

10. The string instrument of claim 1 further comprising a bridge plate for mounting the bridge; and certain springs, wherein the springs are extended between the bridge plate and the inner back of the invention to extend the length of the sounds generated by the soundboard, and for the purpose of creating a reverb effect.

11. The string instrument of claim 1 wherein metal is used to replace conventional material normally used to make the inner back in order to change the characteristics of the sound generated by the primary sound chamber.

12. The string instrument of claim 4, with a sharply angled sidewall and large holes in the inner back.

13. The string instrument of claim 4, with a slightly angled sidewall and small holes in the inner back.

14. The string instrument of claim 1 wherein the invention has an inner back and an outer back, both contoured in the same shape and configuration, residing or spaced in proximity to each other so as to constitute a second sound chamber.

* * * * *